US011388804B2

(12) United States Patent
Van Bommel et al.

(10) Patent No.: US 11,388,804 B2
(45) Date of Patent: Jul. 12, 2022

(54) DYNAMIC SPARKLING LIGHTING DEVICE

(71) Applicant: SIGNIFY HOLDING B.V., Eindhoven (NL)

(72) Inventors: Ties Van Bommel, Horst (NL); Albert Van Dijken, Waalre (NL)

(73) Assignee: SIGNIFY HOLDING B.V.

( * ) Notice: Subject to any disclaimer, the term of this patent is extended or adjusted under 35 U.S.C. 154(b) by 0 days.

(21) Appl. No.: 17/275,152

(22) PCT Filed: Sep. 6, 2019

(86) PCT No.: PCT/EP2019/073852
§ 371 (c)(1),
(2) Date: Mar. 10, 2021

(87) PCT Pub. No.: WO2020/053095
PCT Pub. Date: Mar. 19, 2020

(65) Prior Publication Data

US 2022/0039241 A1 Feb. 3, 2022

(30) Foreign Application Priority Data

Sep. 13, 2018 (EP) ..... 18194143

(51) Int. Cl.
*H05B 47/155* (2020.01)
*H05B 45/10* (2020.01)
(Continued)

(52) U.S. Cl.
CPC ..... *H05B 47/155* (2020.01); *H05B 45/10* (2020.01); *H05B 45/20* (2020.01); *H05B 47/16* (2020.01); *H05B 47/17* (2020.01)

(58) Field of Classification Search
None
See application file for complete search history.

(56) References Cited

U.S. PATENT DOCUMENTS 5,128,595 A 7/1992 Hara
2014/0252987 A1* 9/2014 Hinrichs ..... H05B 45/20 315/297

FOREIGN PATENT DOCUMENTS

GB 2243223 A 10/1991
WO 2009090596 A1 7/2009
(Continued)

*Primary Examiner* — Anh Q Tran
(74) *Attorney, Agent, or Firm* — Daniel J. Piotrowski

(57) ABSTRACT

A lighting device (10) is disclosed that comprises a light mixing chamber (14) at least partially delimited by a first surface (30) carrying a plurality of light sources (28) spatially distributed across said first surface and a second surface (31) arranged to be illuminated by said light sources, said second surface comprising light transmissive regions (33) delimiting light exit areas (32) having a higher light transmissivity than the light transmissive regions, said light transmissive regions exhibiting isotropic luminance and light exit areas exhibiting anisotropic luminance when illuminated by said light sources. The lighting device (10) further comprises a controller (40) adapted to individually control said light sources and having a mode of operation in which the controller is adapted to vary the luminous output of a selection of said light sources as a function of time such that the isotropic luminance of the light transmissive regions is time-independent and the anisotropic luminance of at least some of the light exit areas is time-dependent during said mode of operation.

14 Claims, 5 Drawing Sheets

(51) Int. Cl.

| | |
|---|---|
| ***H05B 45/20*** | (2020.01) |
| ***H05B 47/16*** | (2020.01) |
| ***H05B 47/17*** | (2020.01) |

(56) References Cited

FOREIGN PATENT DOCUMENTS

| | | | | | |
|---|---|---|---|---|---|
| WO | WO-2009090596 | A1 * | 7/2009 | ..... | A61M 21/00 |
| WO | 2014064582 | A1 | 5/2014 | | |
| WO | 2017153252 | A1 | 9/2017 | | |

* cited by examiner

DYNAMIC SPARKLING LIGHTING DEVICE

CROSS-REFERENCE TO PRIOR APPLICATIONS

This application is the U.S. National Phase application under 35 U.S.C. § 371 of International Application No. PCT/EP2019/073852, filed on Sep. 6, 2019, which claims the benefit of European Patent Application No. 18194143.6, filed on Sep. 13, 2018. These applications are hereby incorporated by reference herein.

FIELD OF THE INVENTION

The present invention relates to a lighting device comprising a light mixing chamber at least partially delimited by a first surface carrying a plurality of light sources spatially distributed across said first surface and a second surface arranged to be illuminated by said light sources, said second surface comprising light transmissive regions delimiting light exit areas having a higher light transmissivity than the light transmissive regions, said light transmissive regions exhibiting isotropic luminance and light exit areas exhibiting anisotropic luminance when illuminated by said light sources; and a controller adapted to individually control said light sources.

BACKGROUND OF THE INVENTION

The natural world provides many examples of so called dynamic lighting effects, and these phenomena can, for the observer, be highly captivating and entrancing aesthetic experiences. Consider, for example, sunlight refracted by water droplets or reflected on the moving sea surface, erratic star light, or sunlight blocked sporadically by the moving leaves of a tree. One particularly striking and notable effect is that of sunlight reflecting from snow.

Lighting designers often seek to recreate this striking effect of dynamic lighting in time and space. Dynamic lighting in time is easily realised through individually addressing LEDs within an LED ensemble. Dynamic lighting in space—a variation in light intensity depending on the viewer position—is often achieved through the use of glittering particles, lead glass crystals, or, in more complex solutions, through mechanisms that spatially displace the LED or optics. The effect created by dynamic lighting in space is commonly called glittering, or sparkling.

Glittering as a decorative effect is frequently used in architecture and in interior design, to provide a high end finish to walls or ceilings. It is visually appealing, and can provide a sense of luxury or glamour. Most standardly, glittering is achieved by reflecting light onto specularly reflective particles or by transmitting light through lead glass crystals.

This is usually achieved through applying glittering particles or lead glass crystals onto a surface, and using the reflection of light which is emitted by light sources installed at a distance from the surface. In this case, however, the light source must be installed as a separate component, which is aesthetically invasive and more burdensome and complex to install.

An alternative solution is to install the lead glass crystals into a panel, and to mount the light source(s) directly onto the back of them. Here, the light source remains hidden and the whole apparatus can be provided in a single, unitary panel.

However, use of lead glass crystals to achieve sparkling is not ideal. The crystals are generally expensive and heavy, and mounting them into a panel in order to realise the solution described is far from trivial.

In GB2243223A is described an illumination device designed to simulate the night sky. The device comprises a lighting panel having a front plate comprising holes, and which contains a plurality of conventional light sources, arranged to direct light toward said front plate. Between each of the light sources is positioned a wing reflector element, these elements are provided in order to project a maximum amount of light possible through the apertures of the front plate. To an observer looking at the panel from outside, an effect is created similar to that of a starry night sky.

However, in this solution, the light sources remain visible through the apertures in the front plate over all angles. As a result, a true (spatially dynamic) sparkling effect, in which point sources across the display give the impression of disappearing and appearing briskly as one changes position, is not created.

Furthermore, it may be desirable to provide a sparkling effect in combination with conventional functional illumination for lighting the space within which the lighting device is placed. This allows the appealing aesthetic effect of spatially dynamic sparkling to be created in environments and scenarios where, for reasons of space or of aesthetics, it is not practical or desirable to provide both a luminaire for functional lighting in addition to a dedicated decorative unit for providing the sparkling effect. Such sparkling might also provide an appealing or desirable bonus feature to an otherwise predominantly functionally-targeted lighting product.

An interesting solution is provided in WO2017/153252 A1, which discloses a lighting device configured to provide both functional lighting for illuminating a space, and simultaneously to present a spatially dynamic sparkling light display. The device comprises a chamber containing one or more light sources. The light sources are arranged to direct light in the direction of a translucent surface portion, and in the direction of a plurality of light exit areas delimited by the translucent surface portion. The light exit areas each have a higher transmittance than the surrounding surface portion.

Such a lighting device combines functional lighting and sparkling effects due to the translucent surface portions providing isotropic luminance, i.e. a luminous intensity that is independent of a viewing angle under which an observes looks at the translucent surface portions, whereas the light exit areas provide anisotropic luminance, i.e. luminance depending on viewing angle of the observer looking at the light exit areas. Consequently, an observer changing his or her position relative to the lighting device, e.g. by walking past the lighting device, can observe sparkling effects from the virtual light sources generated by the light exit areas due to the anisotropy in the luminance of these virtual light sources.

In addition, WO2107/153252 A1 teaches that the lighting device may further comprise a controller configured to adjust the output intensity of one set of light sources in dependence upon an output intensity of another, second set of light sources. In case the first set is arranged to avoid directing light onto any light exit area, and the second set is configured to emit light which does fall incident at light exit areas, the controller may be configured to adjust the output intensity of the second set in dependence upon the first set. This may allow the output intensity of the first set to be user-defined, while maintaining the relative intensities, or intensity difference, between the two sets at a fixed level or within some fixed range to ensure that the bright sparkles remain bright enough to still be visible against the background illumination.

Nevertheless, it is desirable to further improve the sparkling effects that such a lighting device can produce.

WO2014064582A1 discloses a lighting device having a housing comprising a light emission window wherein all light sources are mounted on the light emission window.

SUMMARY OF THE INVENTION

The present invention seeks to provide a lighting device according to the aforementioned field of the invention that can produce dynamic sparkling or twinkling effects at least for stationary observers.

According to an aspect, there is provided a lighting device comprising a light mixing chamber at least partially delimited by a first surface of a back panel carrying a plurality of light sources spatially distributed across said first surface and by a second surface of a front panel arranged to be illuminated by said light sources, said second surface comprising light transmissive regions delimiting light exit areas having a higher light transmissivity than the light transmissive regions, said light transmissive regions exhibiting isotropic luminance and light exit areas exhibiting anisotropic luminance when illuminated by said light sources and a controller adapted to individually control said light sources and having a mode of operation in which the controller is adapted to vary the luminous output of a selection of said light sources as a function of time such that the isotropic luminance of the light transmissive regions is time-independent and the anisotropic luminance of at least some of the light exit areas is time-dependent during said mode of operation while the overall luminous output intensity of the plurality of light sources is kept substantially constant. The light sources are arranged on the back panel to direct light in the direction of a light diffusive surface of the front panel, the light sources on the back panel being spaced from the front panel by a spacing S, typically with S>0, such as 1<=S<=10 cm, for example 2<=S<=8 cm, preferably 3<=S<=6 cm. Spacing S needs not to be constant in a single lighting device, but may vary in dependence on the position of an individual light source, for example as might occur in the case of a flat back panel in combination with a curved front panel.

The provision of a controller that has a mode of operation in which the luminous output of a selection of light sources is adjusted as a function of time such that the anisotropic luminance of at least some of the light exit areas is altered as said function of time, i.e. becomes time-dependent, not only generates a sparkle or twinkle effect to an observer changing her or her viewing angle of a virtual light source generated at the illuminated light exit area, but also generates a sparkle or twinkle effect to a stationary observer due to the temporary change in the anisotropy of the virtual light source, thereby enriching the functionality of the lighting device.

In a preferred embodiment, the controller is adapted to change the selection of said light sources after a period of time and adjust a luminous output intensity of the light sources in each selection for said period of time during said mode of operation in order to achieve the aforementioned sparkle or twinkle effect. The period of time may be in a range of 0.5 s to 10 s, preferably in a range of 1 s to 7 s and most preferably in a range of 1.5 s to 5 s. When the period of time is within these ranges, a particularly aesthetically pleasing sparkling effect is obtained, whereas for shorter periods of time the sparking effect may be less noticeable and be perceived more as a flash and for longer periods of time the sparkling effect may be lost due to the virtual light source appearing constant for too long.

Advantageously, each selection of said light sources consists of a plurality of non-neighboring light sources to avoid localized clusters of light sources within such a selection, which may cause localized inhomogeneities in the luminance produced by the light transmissive regions, which is undesirable given that these regions are to produce isotropic luminance for functional lighting purposes.

In order to achieve a time-dependent sparkling effect across multiple viewing angles, each selection preferably comprises between 3-30% of the light sources of the plurality of light sources. For example, the lighting device may comprise at least 20 light sources such as LEDs, or, more preferably, at least 30 light sources, or, most preferably, at least 40 light sources such as 50 light sources or 80 light sources, in which case each selection comprises at least 2 light sources, more preferably at least 4 light sources and most preferably at least 5 light sources such that each selection comprises at least 10%, more preferably at least 13% and most preferably at least 15% of the light sources of the plurality of light sources.

During each period of time, the luminous output intensity of the light sources in the selection may be increased in order to achieve the desired sparkling effect. This for example may be achieved by the controller applying a block-shaped current signal to the light sources in the selection for the duration of the period, i.e. to pulse these light sources. Alternatively, the controller may be adapted to apply a non-block shaped current curve to alter the luminous output intensity of each selection of said light sources for said period of time, wherein different instances of said non-block shaped current curve corresponding to temporally neighboring selections are temporally partially overlapping. This produces a more gentle sparkling effect due to the temporal overlap of these current curves, which causes the light sources of the next selection to fade in whilst the light sources of the previous selection fade out, e.g. back to the luminous intensity level of the non-selected light sources.

The luminous output intensity of non-selected light sources may be kept constant during the mode of operation of the controller in a scenario in which each selection contains the same number of light sources. This ensures that the overall luminous output intensity of the plurality of light sources remains at least approximately constant, which ensures that the isotropic luminance of the light transmissive regions remains at least approximately constant during this mode of operation. In this context the expression "approximately constant", or in other words "substantially constant", means a range of plus or minus 20% around a chosen value for overall luminous output and/or isotropic luminance. However, the controller may be adapted to change the number of selected light sources from one selection to another during this mode of operation. In such a scenario, the controller further may be adapted to adjust the luminous output intensity of at least some of the light sources outside a selection as a function of the number of light sources in said selection during this mode of operation to maintain the isotropic luminance levels of the light transmissive regions. As will be understood, such an adjustment of the luminous output intensity of at least some of the light sources outside a selection is typically in the opposite direction from the adjustment of the luminous output intensity of the light sources within the selection. Typically, the luminous output intensity of the light sources within the selection will be increased whereas the luminous output intensity of at least some of the light sources outside the selection will be decreased.

In a further refinement, the controller is adapted to adjust the luminous output intensity of light sources outside a selection that neighbour light sources in said selection to a lower luminous output intensity than light sources outside said selection that do not neighbour light sources in said selection during said mode of operation, for example to compensate for increases in the luminous output intensity of the light sources in said selection in a localized manner by decreasing the luminous output intensity of at least some neighboring light sources outside the selection to prevent or reduce localized inhomogeneities in the luminance of the light transmissive regions, e.g. in case of imperfect mixing of light emitted by the light sources into the light mixing chamber.

In a further embodiment, the controller further is adapted to vary the colour temperature of the luminous output of a selection of light sources as a function of time such that the colour temperature of the light transmissive regions is time-independent and the colour temperature of at least some of the light exit areas is time-dependent. The controller preferably is adapted to periodically change said selection of light sources after a period of time and adjust the colour temperature of the luminous output of the light sources in each selection for said period of time, wherein the light sources in each selection are divided in a first set of light sources producing light having a first colour temperature and a second set of light sources producing light having a second colour temperature different to the first colour temperature, preferably wherein the first set and the second set contain the same number of light sources. In this manner, the sparkle effect can be further enriched by altering the appearance of the sparkle effect in terms of colour temperature. Similarly, the controller controls single coloured LEDs or combinations of coloured LEDs, for example one or more of amber, white, red, green and blue coloured LEDs, when these are used as the light sources.

The light transmissive regions in at least some embodiments are optically diffusive and preferably have a reflectance of 30-80% in order to achieve their desired isotropic luminance. More preferably, the reflectance is in a range of 35-75%, and most preferably the reflectance is in a range of 40-70%. A higher reflectance ensures a more homogeneous luminous output, whereas a lower reflectance yields a higher luminous efficiency of the lighting device.

The light exit areas in at least some embodiments have an average diameter of at most 5 mm, preferably of at most 4 mm, more preferably of at most 3 mm such that the light exit areas act to produce collimated virtual light sources when illuminated by the plurality of light sources in order to improve the sparkling effect produced by the virtual light sources generated at the light exit areas. In order to achieve a noticeably higher light transmissivity compared to the light exit areas for the purpose of achieving an aesthetically pleasing sparkling effect, the light exit areas in at least some embodiments have a reflectance of less than 12%, preferably of less than 10%, more preferably the light exit areas are transparent.

The first surface preferably is reflective to enhance the luminous efficiency and homogeneity of the luminous output of the lighting device. For this reason, the reflectivity of the first surface preferably is at least 80%, more preferably at least 85% and most preferably at least 90%.

Preferably, the light sources are LEDs, wherein said LEDs preferably are white light-emitting LEDs. Such light sources act as (approximate) point sources, which makes them particularly suitable for the generation of the desired sparkling effects.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
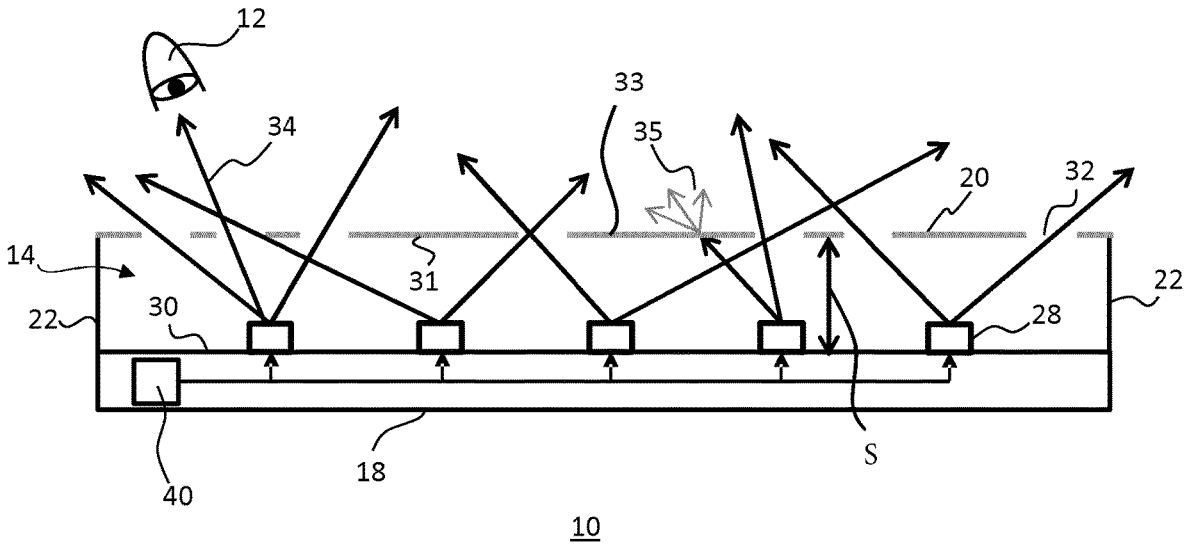
FIG. 1 schematically depicts a lighting device according to an example embodiment.

It should be understood that the Figures are merely schematic and are not drawn to scale. It should also be understood that the same reference numerals are used throughout the Figures to indicate the same or similar parts.

The invention provides a lighting device such as a luminaire configured to provide both functional lighting for illuminating a space, and simultaneously to present a spatially dynamic sparkling light display. The lighting device comprises a light mixing chamber containing one or more light sources. The light sources are arranged to direct light in the direction of a light diffusive surface, and in the direction of a plurality of light exit areas each delimited by a region of the light diffusive surface. The light exit areas each have a higher transmittance than the light diffusive surface regions.

Light incident at the light diffusive surface is transmitted from the lighting device at a higher level of attenuation than light incident at any of the light exit areas. The relative transmittance of the light exit areas and the surrounding regions of the light diffusive surface is configured to ensure sufficiently high luminous contrast between the apparent intensity of a light exit area when in alignment with a light source and an observer's eye, and the apparent luminosity of their surrounding regions. This ensures that only when an observer's eye is in such an alignment, the light source is visible to the observer at its full intensity. As soon as this alignment breaks, the light source appears to the observer to vanish from view, or at least to significantly diminish or alter in intensity. It is this effect which provides the spatially dynamic glittering or sparkling light effect, as also disclosed in WO2017/153252 A1.

FIG. 1 schematically illustrates a first example of a lighting device 10 in accordance with an embodiment of the present invention, which is demonstrative of the general concept of the invention embodied by all examples of the invention. The lighting device 10 comprises a panel or box shaped frame or structure whose interior comprises a light mixing chamber 14 which is delimited by a back panel 18 having an inner surface 30 facing the light mixing chamber 14, side panels (of which only two 22, 24 are shown in FIG. 1), and an optically transmissive front panel 20 having an inner surface 31 facing the light mixing chamber 14. The optically transmissive front panel 20 in accordance with this example may be translucent across its full dimensions. That is, the optically transmissive front panel 20 may act as an optical diffuser having a reflectance in a range of 30-80%, which may be achieved in any suitable manner, e.g. by including scattering particles in the optically transmissive front panel 20, using a translucent material for the optically transmissive front panel 20, and so on.

Figure 2:
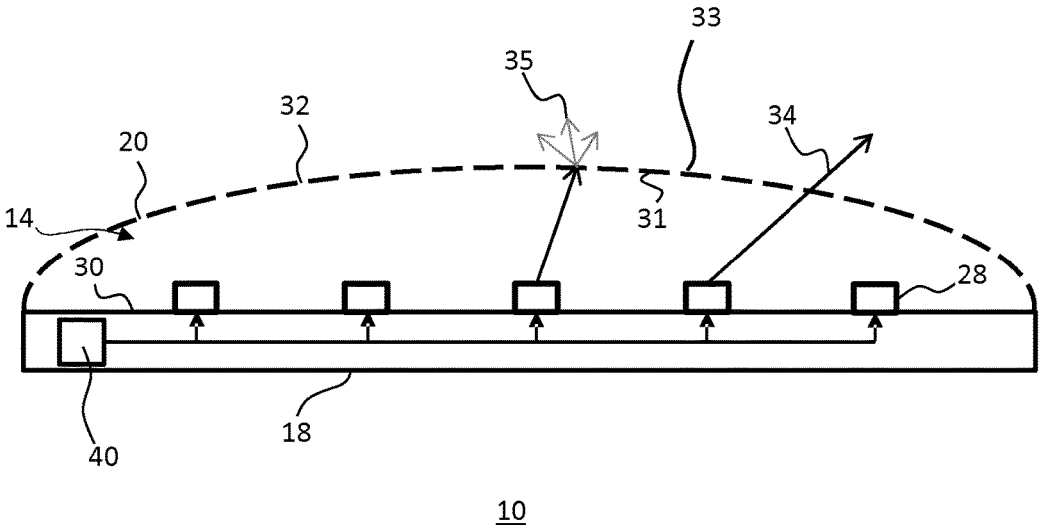
FIG. 2 schematically depicts a lighting device according to another example embodiment.

The panel or box embodiment of FIG. 1 comprises six internal surfaces, which include the respective interior surfaces of each of: the back panel 18, the translucent front panel 20, first side panel 22, and second side panel 24 (plus two additional side panels, not shown). It is emphasised that this particular shape, having an internal surface arrangement comprising six surfaces is shown by way of example only, and other arrangements comprising for example a triangular or other polygonal shaped device may also be used. For example, as schematically depicted in FIG. 2, the side panels 22 have been omitted and the optically transmissive front panel 20 is dome-shaped.

Many other suitable shapes of the lighting device 10 will be immediately apparent to the skilled person. It should be understood that application of the invention is not limited to embodiments of a lighting device 10 comprising regular shaped constructions, such as spherical, cylindrical or cubic shaped outer shells or frames. Other embodiments may comprise inner light mixing chambers 14 bound by optically transmissive outer frames or structures of any shape, either regular or irregular. For example, the lighting device 10 may comprise an inner light mixing chamber 14 bound by an outer surface or shell structure shaped to form a custom 3D shape. The custom 3D shape might for example be modelled on a particular 3D object or 3D object design.

According to particular examples, at least the inner surface 30 of the back panel 18 may be white, may be partially or fully reflective, may be adapted to only reflect light of particular colours, or may have any other surface properties. The back panel 18 may, by way of non-limiting example only, comprise or consist of a printed circuit board (PCB), metal core printed circuit board (MCPCB) or a metal plate for instance. Other suitable materials will be immediately apparent to the skilled person.

In examples, one or more of the internal surfaces of the light mixing chamber 14 may be partially or fully reflective. Such partial or full reflectivity may assist in emitting from the light mixing chamber 14 a maximal level of functional light for illuminating the space within which the lighting device 10 is placed, as will be explained in further detail below. For example, one or more of the internal surfaces of the light mixing chamber 14 may be white, so as to thereby reflect light of spectral compositions corresponding to all colour components of light. In further examples, one or more of the internal surfaces may be specularly reflective, or mirrored, surfaces.

A plurality of light sources 28 are disposed within the light mixing chamber 14, which are mounted on the inner surface 30 of back panel 18. The light sources 28 are spatially separated from the optically transmissive front panel 20 and are spatially separated from each other, such that the back panel 18 may comprise a plurality of point light sources spatially separated by dark areas, i.e. areas in which no light sources are present. Such distributed light sources 28 may generate the desired sparkling effect as will be explained in more detail below.

In at least some embodiments, the light sources 28 may be, or may comprise, solid state light sources, such as LEDs. Use of LEDs provides for high energy efficiency and also relatively sharp directionality of emitted light. The light sources 28 may be provided in any suitable manner, such as mounted via a Metal Core Printed Circuit Board (MCPCB). Flip-chip LEDs may be provided mounted directly onto a PCB. Other suitable mounting arrangements of the light sources 28 will be immediately apparent. In accordance with at least a further set of embodiments, the device may be adapted to produce sparkle effects of different colours under different viewing angles.

For example, the lighting device 10 may comprise a plurality of LEDs each having a light exit surface covered by a suitable phosphor to alter the spectral composition of the light produced by the LED as it travels through the phosphor layer. As is well-known per se, such arrangements typically produce colour over angle (COA) effects due to the angular dependence of the length of the path of the emitted light through the phosphor layer, which may lead to the generation of a sparkle effect of different colours at different viewing angles of the emitted light. In a particular embodiments, the light sources 28 are white light LEDs, in which the white light may be generated using such a phosphor layer or in any other suitable manner, as is well-known per se and will therefore not be explained in further detail for the sake of brevity only.

The light sources 28 are operable to emit light in a range of propagation angles in directions toward a plurality of light exit areas 32 formed at various locations through optically transmissive front panel 20. The light exit areas 32 are configured having an optical transmittance which is greater than the surrounding regions of the optically transmissive front panel 20 which defines or delimits them. As shown by arrow 34 in FIG. 1, light incident at a light exit area is transmitted directly through said light exit areas 32. Each light exit area 32 preferably has an average diameter of less than 5 mm, more preferably of less than 4 mm and most preferably of less than 3 mm such that the light exit areas 32 can act as collimating structures for the light of the light sources 28 propagating through the light exit areas 32. This further enhances the sparkling effect as the light exit areas act as virtual light sources within the optically transmissive front panel 20.

In order to further increase the density of the virtual light sources generated by the light exit areas 32, the lighting device 10 may comprise more light exit areas 32 than light sources 28, preferably two times more light exit areas 32 than light sources 28, more preferably four times more light exit areas 32 than light sources 28 and most preferably five times more light exit areas 32 than light sources 28.

The light exit areas 32 preferably are transparent but alternatively may have some reflectance, e.g. in case of a filter or the like (not shown) being present in or on each of the light exit areas 32, e.g. to reduce the risk of glare to an observer. In such a scenario, each light exit area 32 has a reflectance of less than 12%, preferably of less than 10% and more preferably of less than 9%.

The arrangement of a plurality of light sources 28 on a mounting portion 30 may be such that each light source is horizontally or laterally displaced from any light exit area 32 of the front panel 20. The effect of this is that an observer looking through a light exit area, in a direction of the optical axes of the light sources, is not able to observe the full arrangement of the light sources lying beneath. This adds to the interest and enjoyment of the resultant lighting device 10, since the mechanical workings providing the sparkling effect are not immediately apparent.

In an example embodiment, the light sources 28 are arranged according to a first regular pattern, and the light exit areas 32 are arranged according to a second different regular pattern. The patterns may differ in the pitch between neighbouring light sources 28 and/or light exit areas 32, or may differ simply in their relative alignment, so that the elements of the first pattern are arranged to interleave with the elements of the second pattern.

Alternatively, the light exit areas 32 and/or the light sources 28 may be arranged according to an irregular pattern, such as a random or semi-random pattern. The advantage of using such a pattern for one of either the light exit areas or the light sources is that this affords a degree of freedom in the arrangement of the other, since substantial non-alignment of light sources and light exit areas may be expected to follow automatically from the irregularity of the pattern used. For instance, by arranging the light exit areas 32 semi-randomly, this allows the light sources 28 to be arranged according to a standard regular array configuration, which may be substantially cheaper and easier to manufacture.

By random or semi-random is meant a pattern or arrangement for example in which the separation distance, pitch or relative angular arrangement of subsequent or adjacent elements in the pattern (light sources or light exit areas) differs or varies in a non-regular way. In particular examples, the light sources 28 and/or light exit areas 32 may be arranged to follow a Voronoi-like pattern or arrangement.

The light sources 28 in some embodiments may be provided in a regular N×M array (in which M, N are positive integers), an irregular array, or may be positioned in an arbitrary arrangement.

As shown by arrows 35, light incident at the optically transmissive front panel 20 is attenuated as it passes through the panel to a greater extent than light passing through light exit areas 32, with the result that this light appears dimmer or less intense than light 34 emitted via the light exit areas 32. The light corresponding to arrows 35 may provide 'background' or functional illumination suitable for lighting a space such as for example a room, while the light exiting directly via the light exit areas 32 as indicated by arrow 34 appears to an observer (whose eye 12 is in the appropriate alignment with the respective light source 28) as bright spots of light superposed on top of the background illumination. These bright spots coming into and out of alignment as the observer moves create a spatially dynamic glittering or sparkling effect on top of a relatively dimmer background layer of illumination. The overall effect is comparable to the sparkling effect generated by snow illuminated by sunlight.

The virtual light sources produced by the light exit areas 32 may therefore be considered to produce anisotropic luminance, i.e. illumination of which the perceived intensity is a function of the angle under which an observer observes the virtual light source. In contrast, the functional illumination produced by the optically transmissive front panel 20, i.e. the more opaque regions 33 surrounding the light exit areas 32, may be considered to have isotropic luminance as the intensity of the light produced by these regions is largely independent of the angle under which the observer observes these regions of the lighting device 10.

In accordance with the present invention, the lighting device 10 further comprises a controller 40 adapted to control the light sources 28 in an individual manner, i.e. each light source 28 can be individually addressed by the controller 40. The controller 40 may be located in any suitable location within the lighting device 10, such as in the back panel 18 by way of non-limiting example. The controller 40 has a mode of operation in which the luminous output of selected light sources 28, i.e. only some of the light sources 28, is varied, e.g. increased, for a limited period of time. At the same time, the overall luminous output of the lighting device 10 preferably is kept constant during this mode of operation such that the isotropic luminance of the aforementioned functional lighting remains substantially constant, whilst the anisotropic luminance of the 'sparkling' virtual light sources becomes time-dependent. This will be explained in further detail below.

The controller 40 may have any suitable number of modes of operation including the aforementioned mode of operation. For example, the aforementioned mode of operation may be the only mode of operation of the controller 40 or alternatively the controller 40 may comprise a further mode of operation in which both the isotropic and anisotropic luminance as described above are time-independent, e.g. all the light sources 28 may be driven in a constant manner by the controller 40 in this further mode of operation. The desired mode of operation of the controller 40 may be selected in any suitable manner. For example, the lighting device 10 may comprise a user interface (not shown) such as a switch, button, touch screen or the like through which a user can select the desired mode of operation of the controller 40. Alternatively, the controller 40 may be responsive to a network interface, such as a wireless or wired communication interface, through which the controller 40 may receive a mode selection signal from a remote control device. As such mode selection techniques are well-known per se, they will not be explained in further detail for the sake of brevity only.

In an embodiment, the controller 40 is adapted to temporarily increase the luminous output intensity (luminous flux) of the selected lighting devices 28 for a limited period of time. This has the effect that the luminous output intensity of a virtual light source in alignment between an observer and a selected light source 28 will temporarily appear brighter to the observer, i.e. the virtual light source has a time-dependent anisotropic luminance. This therefore adds another dimension to the sparkling effect produced by the lighting device 10, as in addition to the sparkling effect explained above with regards to an observer changing his or her viewing angle of the lighting device 10 a sparkling effect is also experienced by a stationary observer. In order to obtain an aesthetically optimal sparkling effect, the period of time during which the luminous output of the selected light sources 28 is adjusted, e.g. increased or decreased, preferably has a minimum duration of at least 0.5 s, more preferably of at least is and most preferably of at least 1.5 s and a maximum duration of at most 10 s, more preferably of at most 7 s and most preferably of at most 5 s.

Figure 3:
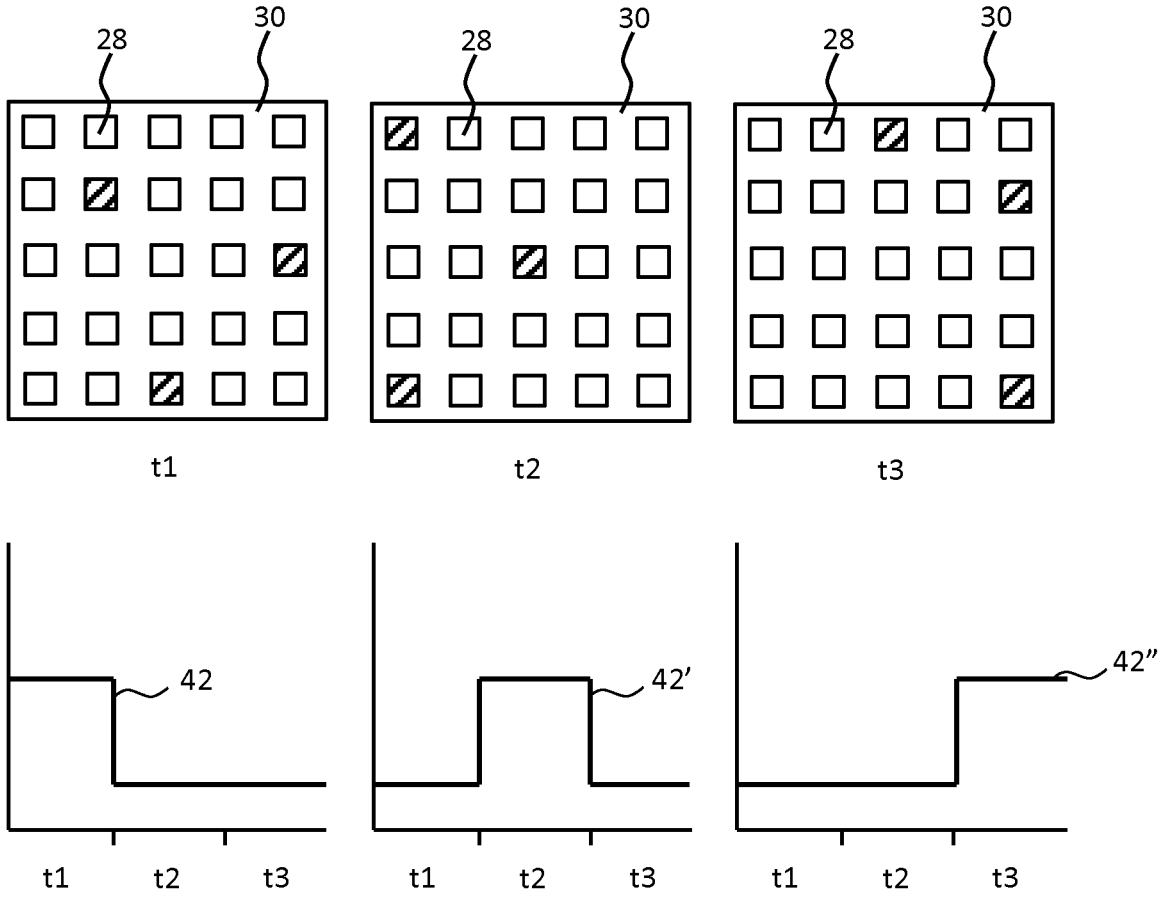
FIG. 3 schematically depicts an operating mode of such a lighting device according to an example embodiment.

In a particularly advantageous embodiment, the controller 40 is adapted to periodically change the selection of light sources 28, i.e. after completion of the aforementioned period of time such that the luminous output intensity of different selections of light sources 28 are sequentially altered during this mode of operation. This is schematically depicted in FIG. 3, which shows 25 light sources 28 mounted in a 5×5 grid on the surface 30 of the back panel 18 by way of non-limiting example only. For each period of time t1, t2, t3 three different light sources 28 as highlighted by the shaded squares in FIG. 3 are selected by the controller 40 and their luminous output intensity is increased during these periods, as indicated by the control signals 42, 42' and 42" provided by the controller 40 to the selected light sources 28 during the time periods t1, t2 and t3 respectively. This results in the lighting device 10 giving the appearance of different brightening virtual light sources at different periods of time due to the changing locations of the selected light sources 28 on the surface 30, thereby adding further interest to the appearance of the lighting device 10. The controller 40 may select the light sources 28 in any suitable manner, e.g. using a random or pseudo-random selection algorithm. The algorithm may deploy a selection evaluation in which selections of spatially neighboring light sources 28 are rejected to avoid clustering of the selected light sources 28, as this may lead to localized bright spots on the light transmissive front panel 20, which is undesirable.

The duration of this mode of operation of the controller 40 may be unbound, such that the mode of operation terminates only in response to a corresponding user instruction. Alternatively, this mode of operation of the controller may have a defined duration, e.g. a defined number of time periods during which a particular selection of light sources 28 as explained above is made, after which the controller 40 may return to a default mode of operation.

The controller 40 may deploy any suitable type of control signal to the light sources 28, e.g. a voltage-based and/or a current-based control signal. The control signal may have any suitable shape, such as the block-shaped control signals 42, 42' and 42" schematically depicted in FIG. 3. As will be appreciated by the skilled person, this has the consequence that each selection of light sources during time periods t1, t2 and t3 exhibit an approximately instantaneous increase in luminous output intensity from their baseline intensity level to the increased intensity level when selected, which means that the appearance of the lighting device 10 will exhibit abrupt changes when changing the selection of light sources 28 when transitioning from one time period to another (e.g. from t1 to t2, from t2 to t3, and so on).

Figure 4:
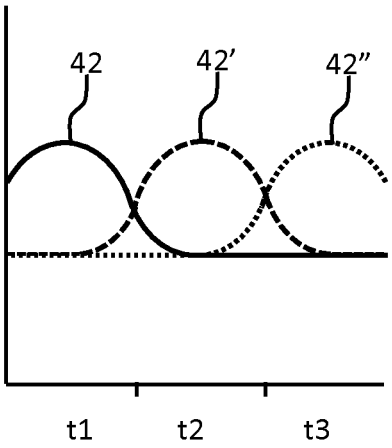
FIG. 4 schematically depicts a control signal for an operating mode of such a lighting device according to another example embodiment.

If this is undesirable, the controller 40 alternatively may deploy a non-block shape control signal such as schematically depicted in FIG. 4. Such control signals 42, 42' and 42" partially overlap in terms of the portion (pulse) of these control signals causing the increased luminous output intensity of the selected light sources 28 addressed by these control signals. In other words, these portions or pulses of the control signals extend beyond the designated time periods, thereby achieving a blended fading in and fading out of different selections of light sources 28 and avoiding the abrupt changes in the appearance of the lighting device 10 associated with the block-shaped control signals 42, 42' and 42" schematically depicted in FIG. 3.

In the above example embodiment, the different selections (during time periods t1, t2 and t3) contain the same number of light sources 28. Consequently, the remaining light sources 28 outside each selection may be driven by the controller 40 in a constant manner, e.g. at some baseline level, i.e. without varying their luminous output intensity to retain a constant total luminous output intensity produced by the combined light sources 28 as the number of light sources 28 driven at an elevated luminous output intensity is constant during this mode of operation. However, in an alternative embodiment the controller 40 may vary the number of selected light sources 28 across the various time periods t1, t2, t3. In this embodiment, the controller 40 therefore needs to take additional measures to ensure that the total luminous output intensity produced by the selected and non-selected light sources 28 remains substantially constant during this mode of operation.

Figure 5:
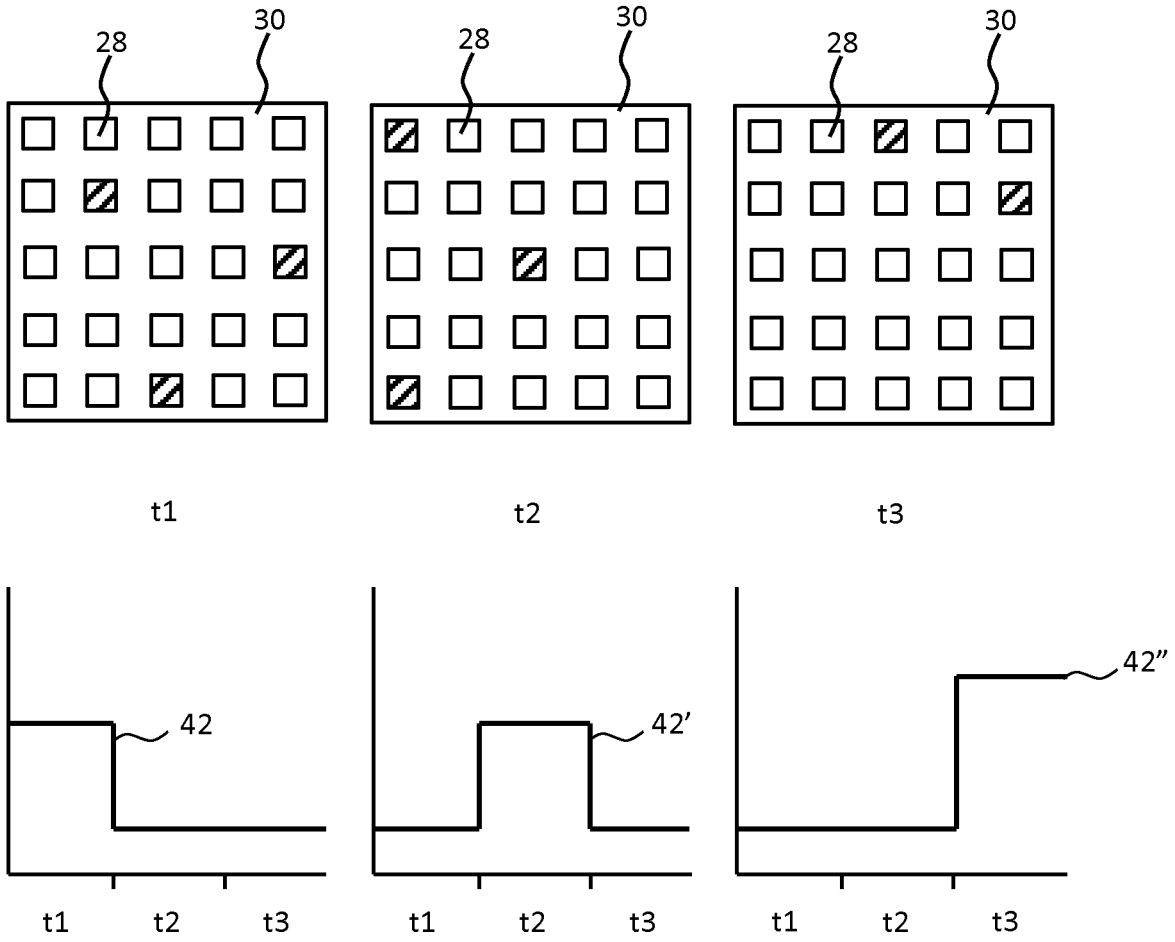
FIG. 5 schematically depicts an operating mode of such a lighting device according to yet another example embodiment.

FIG. 5 schematically depicts a first example embodiment in which this is achieved by adjusting, e.g. increasing, the luminous output intensity of the selected light sources 28 by an amount that is a function of the number of light sources 28 in a selection. The selections during periods t1 and t2 each contain three light sources 28 whereas the selection during period t3 contains only two light sources. In order to contain a combined constant luminous output intensity, the luminous output intensity of each of the selected light sources 28 in period t3 is 150% of the luminous output intensity of each of the selected light sources 28 in period t1 and t2, as demonstrated by the larger pulse or block in the control signal 42" compared to control signals 42 and 42'. More generally speaking, where a selection contains M light sources 28 and a target combined luminous output intensity of the selection is N lm, each selected light source 28 will be driven to a luminous output intensity of N/M lm. Consequently, the remaining light sources 28 outside each selection may be driven by the controller 40 in a constant manner, e.g. at some baseline level, i.e. without varying their luminous output intensity to retain a constant total luminous output intensity produced by the combined light sources 28 as the combined luminous output intensity of each selection of light sources 28 is constant during this mode of operation.

Figure 6:
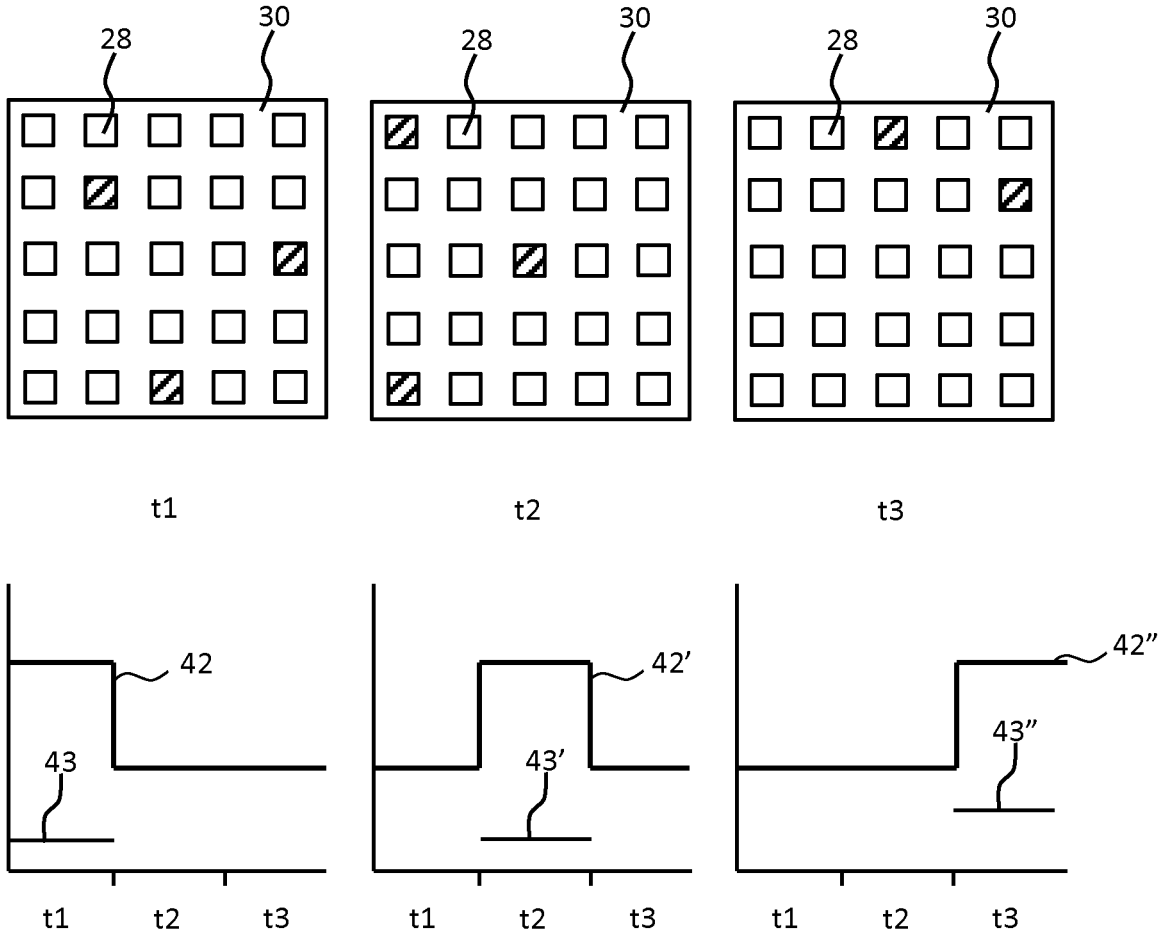
FIG. 6 schematically depicts an operating mode of such a lighting device according to yet another example embodiment.

FIG. 6 schematically depicts a second example embodiment in which the baseline level at which the non-selected light sources 28 are driven by the controller 40 is set as a function of the number of selected light sources 28 in a particular selection in order to retain a constant total luminous output intensity produced by the combined light sources 28 for the duration of this mode of operation of the lighting device 10. In this embodiment, the selected light sources 28 during periods t1, t2, t3 are driven to the same elevated luminous output intensity, even though the selection in period t3 contains fewer (2) light sources 28 than the selections (3) of periods t1 and t2. Hence, the total luminous output intensity produced by the combined light sources 28 in these selections is lower during period t3 owing to the smaller number of selected light sources 28 in this selection. This is compensated by increasing the baseline level at which the non-selected light sources 28 are driven by the controller 40 during period t3, as shown in FIG. 6 by the baseline levels 43, 43' and 43", with the baseline level 43" being elevated relative to the baseline levels 43 and 43'. More generally speaking, where a lighting device 10 contains a total of L light sources 28 and has a target combined luminous output intensity of Q lm, during a given period of time the total luminous output intensity of a selection of M light sources 28 is P lm, the remaining (L−M) light sources 28 in the lighting device 10 are each driven to a baseline level of (Q−P)/(L−M) lm in order to ensure that the total luminous output intensity produced by the selected and non-selected light sources 28 remains substantially constant during this mode of operation.

Figure 7:
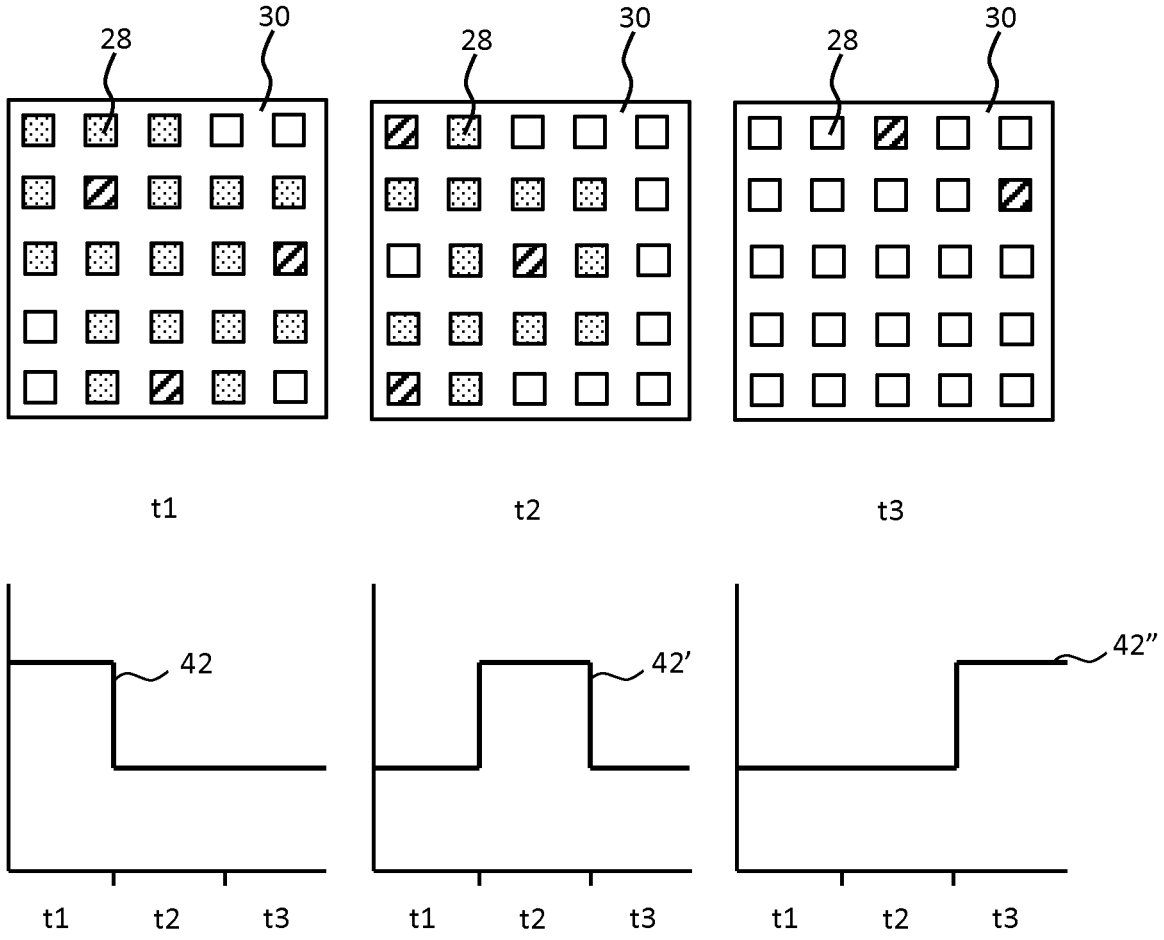
FIG. 7 schematically depicts an operating mode of such a lighting device according to yet another example embodiment.

FIG. 7 schematically depicts a third example embodiment in which the baseline level at which the non-selected light sources 28 are driven by the controller 40 is set as a function of the number of selected light sources 28 in a particular selection as well as a function of the relative location of a non-selected light source 28 to a selected light source 28 in order to retain a constant total luminous output intensity produced by the combined light sources 28 for the duration of this mode of operation of the lighting device 10. In this embodiment, non-selected light sources 28 that neighbour a selected light source 28 in a particular period of time t1, t2, t3 are driven to a lower baseline level than non-selected light sources 28 that do not neighbour such a selected light source 28. Such neighboring light sources 28 are identified by the speckled squares and such non-neighboring light sources 28 are identified by the white or unfilled squares in FIG. 7. This for example aids the homogeneity of the isotropic functional luminous output of the lighting device 10 as produced by the regions 33 of the light transmissive front cover 20 delimiting the light exit areas 32, as the brighter selected light sources 28 are neighboured by more dimmed non-selected light sources 28, such that effective intermixing of the light of these light sources in the light mixing chamber 28 to a homogeneous luminance level can be more easily achieved.

In the foregoing, the controller 40 has been described to periodically and temporarily control the luminous output intensity of selected light sources 28 in a sequential manner. However, it should be understood that embodiments of the present invention are not limited to controlling the luminous output intensity of selected light sources 28. Additionally or alternatively, the controller may be adapted to control the colour temperature of the selected light sources 28, e.g. in case of white light LEDs. The controller 40 preferably is adapted to control the light sources 28 during this mode of operation such that the isotropic background illumination has a time-independent colour temperature whilst the anisotropic sparkling virtual light sources have a time-dependent colour temperature, thereby producing a sparkling effect in which at least some of the sparkling effects may change location as well as appearance in terms of colour temperature compared to the background illumination.

To this end, each selection of light sources 28 made by the controller 40 during time intervals or periods t1, t2, t3 preferably is divided into two sets of light sources 28; a first set of light sources 28 producing light having a first colour temperature and a second set of light sources 28 producing light having a second colour temperature different to the first colour temperature. The first colour temperature and the second colour temperature may be chosen such that when light rays having these colour temperatures are intermixed, the resulting colour temperature resembles or corresponds to the colour temperature of the light produced by the non-selected light sources 28 in that time period. This ensures that the virtual light sources exhibit a colour temperature different to that of the background illumination whilst ensuring that the colour temperature of the background remains substantially constant during this mode of operation. For this reason, the first set and the second set preferably contain the same number of light sources such that equal amounts of light of the first and second colour temperatures are produced, thereby maintaining the colour temperature of the background illumination. Of course, where the respective luminous output intensities of light sources 28 differ between the first and second set, the numbers of selected light sources 28 in each of these sets may be unequal in order to ensure that equal amounts of light of the first and second colour temperatures are produced, in analogy with the example embodiment of FIG. 5 as will be readily understood by the skilled person.

Although the lighting device 10 may have any suitable dimensions, in a preferred embodiment the optically transmissive front plate 20 has a surface area of at least 1 $dm^2$, more preferably of at least 2 $dm^2$, and most preferably of at least 3 $dm^2$. The lighting device 10 and light exit areas 32 preferably are further dimensioned such that at a viewing distance of 1 m from the lighting device 10, no more than a single light source 28, e.g. a single LED, can be directly observed by an observer. The light transmissive front plate 20 of the lighting device 10 comprises at least 50 light exit areas 32, more preferably at least 80 light exit areas 32 and most preferably at least 100 light exit areas 32 when adhering to the aforementioned preferred surface area of the optically transmissive front plate 20. In other words, the optically transmissive front plate 20 has a density of at least 50 light exit areas 32 per $dm^2$ of surface area to ensure the observability of the desired sparkling effect from a large number of viewing angles.

To this end, a lighting device 10 adhering to such design and dimensional constraints preferably comprises at least 20 light sources 28, more preferably at least 40 light sources 28 and most preferably at least 50 or 80 light sources 28, e.g. LEDs such that the lighting device 10 comprises at least 20 light sources 28 for each $dm^2$ of surface area of the optically transmissive front plate 20. In order to ensure that during the above described mode of operation of the controller 40 a sparkling effect can be observed under a sufficiently large number of viewing angles, each selection of light sources 28 during one of the time periods t1, t2, t3 comprises at least 2 light sources 28, more preferably at least 4 light sources 28 and most preferably at least 5 light sources 28. Alternatively, the number of selected light sources 28 in each selection is in a range of 3-30% of the total number of light sources 28 in the lighting device 10, more preferably in a range of 4-25% of the total number of light sources 28 in the lighting device 10 and most preferably in a range of in a range of 5-20% of the total number of light sources 28 in the lighting device 10. For example, at least 10%, such as at least 13% or at least 15% may be selected (pulsed) at the same time by the controller 40.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising:

a light mixing chamber at least partially delimited by a first surface of a back panel carrying a plurality of light sources spatially distributed across said first surface and by a second surface of a front panel arranged to be illuminated by said light sources, said second surface comprising light transmissive regions delimiting light exit areas having a higher light transmissivity than the light transmissive regions, said light transmissive regions exhibiting isotropic luminance and light exit areas exhibiting anisotropic luminance when illuminated by said light sources, a light source is visible to an observer only when a light exit area is in alignment with a light source and an observer's eye and a controller adapted to individually control said light sources and having a mode of operation in which the controller is adapted to vary the luminous output of a selection of said light sources as a function of time such that the isotropic luminance of the light transmissive regions is time-independent and the anisotropic luminance of at least some of the light exit areas is time-dependent during said mode of operation while the overall luminous output intensity of the plurality of light sources is kept substantially constant, in that the controller further is adapted to adjust the luminous output intensity of at least some of the light sources outside said selection as a function of the number of light sources in said selection during said mode of operation to compensate for increases in the luminous output intensity of the light sources in said selection.

2. The lighting device of claim 1, wherein the controller is adapted to change the selection of said light sources after a period of time (t1, t2, t3) and adjust a luminous output intensity of the light sources in each selection for said period of time during said mode of operation.

3. The lighting device of claim 2, wherein said period of time (t1, t2, t3) is in a range of 0.5 s to 10 s, preferably in a range of 1 s to 7 s and most preferably in a range of 1.5 s to 5 s.

4. The lighting device of claim 2, wherein the controller is adapted to apply a non-block shaped current curve to alter the luminous output intensity of each selection of said light sources for said period of time (t1, t2, t3), wherein different instances of said non-block shaped current curve corresponding to temporally neighboring selections are temporally partially overlapping.

5. The lighting device of claim 1, wherein each selection of said light sources consists of a plurality of non-neighboring light sources.

6. The lighting device of claim 1, wherein each selection comprises between 3-30% of the light sources of the plurality of light sources.

7. The lighting device of claim 1, wherein the controller is adapted to adjust the luminous output intensity of light sources outside a selection that neighbour light sources in said selection to a lower luminous output intensity than light sources outside said selection that do not neighbour light sources in said selection during said mode of operation.

8. The lighting device of claim 1, wherein the first surface is reflective.

9. The lighting device of any of claim 1, wherein the controller further is adapted to vary the colour temperature of the luminous output of a selection of light sources as a function of time such that the colour temperature of the light transmissive regions is time-independent and the colour temperature of at least some of the light exit areas is time-dependent.

10. The lighting device of claim 9, wherein the controller is adapted to periodically change said selection of light sources after a period of time (t1, t2, t3) and adjust the colour temperature of the luminous output of the light sources in each selection for said period of time, wherein the light sources in each selection are divided in a first set of light sources producing light having a first colour temperature and a second set of light sources producing light having a second colour temperature different to the first colour temperature, preferably wherein the first set and the second set contain the same number of light sources.

11. The lighting device of claim 1, wherein the light transmissive regions are optically diffusive and preferably have a reflectance of 30-80%.

12. The lighting device of claim 1, wherein the light exit areas have an average diameter of at most 5 mm, preferably of at most 4 mm, more preferably of at most 3 mm.

13. The lighting device of claim 1, wherein the light exit areas have a reflectance of less than 12%, preferably of less than 10%, more preferably the light exit areas are transparent.

14. The lighting device of claim 1, wherein the light sources are LEDs, wherein said LEDs preferably are white light-emitting LEDs.

* * * * *